United States Patent [19]

Nachtrieb

[11] Patent Number: 4,826,402

[45] Date of Patent: May 2, 1989

[54] HIGH-CAPACITY CENTRIFUGAL PUMP

[76] Inventor: Paul W. Nachtrieb, 6392 Park Ave., Garden Grove, Calif. 92645

[21] Appl. No.: 132,797

[22] Filed: Dec. 14, 1987

Related U.S. Application Data

[63] Continuation of Ser. No. 845,561, Mar. 28, 1986, abandoned.

[51] Int. Cl.[4] ..... F04D 17/08

[52] U.S. Cl. ..... 415/206; 416/186 R

[58] Field of Search ..... 415/203, 206, 213 C, 415/219 C; 416/186 R, 187 R

[56] References Cited

U.S. PATENT DOCUMENTS

| | | | |
|---|---|---|---|
| 1,278,721 | 9/1918 | Nachenius | 415/219 C X |
| 1,633,609 | 6/1927 | Schmidt | 416/187 |
| 2,138,814 | 12/1938 | Bressler | 416/186 X |
| 2,264,071 | 11/1941 | Dibovsky | 415/206 |
| 2,418,012 | 3/1947 | Chester | 416/187 |
| 3,095,821 | 7/1963 | Elenbaas | 415/206 X |
| 3,136,254 | 6/1964 | Douglas | 415/206 |
| 3,561,906 | 2/1971 | Fermer | 415/206 X |
| 3,628,881 | 12/1971 | Herrmann, Jr. | 416/186 R X |
| 4,129,402 | 12/1978 | Eberhardt | 415/206 X |

FOREIGN PATENT DOCUMENTS

| | | | |
|---|---|---|---|
| 2152359 | 5/1973 | Fed. Rep. of Germany | 415/206 |
| 2203897 | 8/1973 | Fed. Rep. of Germany | 415/206 |
| 117918 | 9/1979 | Japan | 415/206 |
| 69799 | 5/1980 | Japan | 415/206 |
| 669088 | 6/1979 | U.S.S.R. | 415/206 |

*Primary Examiner*—Robert E. Garrett

*Assistant Examiner*—Joseph M. Pitko

*Attorney, Agent, or Firm*—Plante, Strauss & Vanderburgh

[57] ABSTRACT

A high capacity centrifugal pump for the transfer of liquids is presented. The pump comprises four major components held in rigid assembly by means of screws and pins: a drive unit which includes a drive shaft, a keyway and key, an end play control collar and an impeller mounting fixture; a one piece pump housing comprising mounting legs and a large internal diameter outlet port, a circular pump chamber cavity and a shaft hole containing a lip seal and a pair of flanged sleeve bearings; a one piece impeller of a width slightly less than its diameter; an end plate encompassing a large diameter inlet port. The drive shaft and attached impeller are mounted off center in the cylindrical pump chamber to permit liquid escaping from the impeller to enter a surrounding area which closely resembles the volute chambers common to conventional single stage centrifugal pumps. Operation is identical to similar pumps in that liquid to be transported is admitted to the pump's inlet port which is concentric to the open end center of the impeller that is rotated at high speed by external drive means, the liquid is momentarily trapped between the impeller blades, is accelerated to high velocity and thrown from the impeller into the surrounding escape chamber where its kinetic energy is partially converted to pressure, the liquid exiting through the outlet port. The pump has large inlet and outlet ports, which can equal the diameter of the pump impeller; and has an impeller with a width equal to or greater than its diameter.

22 Claims, 2 Drawing Sheets

HIGH-CAPACITY CENTRIFUGAL PUMP

This is a continuation of application Ser. No. 845,561 filed Mar. 28, 1986, now abandoned.

BACKGROUND OF THE INVENTION

1. Field of the Invention

The present invention consists of a high-capacity centrifugal pump. Such a pump may be used to transport a wide variety of liquids, to fulfill a broad range of applications wherever a pump of this type may be required.

2. Description of the Prior Art

Centrifugal pumps (sometimes referred to by the pump industry as "the king of pumps") were invented in France around the middle of the nineteenth century. Before their introduction to the pumping industry, only positive displacement pumps were available (i.e., specifically, piston and rotary types). These were costly to manufacture since the machine tool industry had not been well developed and high-production techniques were generally unknown. Centrifugal pumps, because of their inherent simplicity, durability and low fabrication cost, quickly replaced more expensive positive displacement pumps and the bulk of pump research and development throughout the world was slanted to the perfection of the many varieties of velocity (centrifugal) pumps required by growing industries. Today, the most widely used pump type is of the centrifugal variety since it combines many of the most desirable attributes required of pumps in general use. A major improvement in centrifugal pump design and performance should be of significant value to the pumping industry and especially to the end user who pays for everything.

Small (less than 500 GPM capacity) centrifugal pumps are notoriously inefficient, due, principally, to the low velocity imparted to the fluids pumped when such pumps are driven by commonly available drive means such as 1725 RPM or 3450 RPM electric motors. In addition, small centrifugal pumps have a low ratio betwen contained volume and their interior surface resulting in a relatively high level of friction between the moving fluid and the impeller and pump chamber walls. Large centrifugal pumps with impellers of greater diameter and width impart high velocity to the fluids they transport and a higher ratio between contained volume and interior surface is present thereby reducing friction and improving efficiency. Comparatively few small centrifugal pumps develop hydraulic horsepower efficiencies in excess of 50% at maximum head in contrast to very large pumps capable of efficiencies of 91% and slightly higher. It is further true that the useful life of larger pumps is generally greater than that of smaller pumps since the larger pumps may be operated effectively at lower speeds, reducing wear on moving parts.

Contrary to the commonly-held belief by centrifugal pump designers and engineers, it has been discovered that fluids to be pumped need not dwell in the compartments of centrifugal pump impellers for the length of time long considered essential to impart maximum velocity to the fluids pumped. The scientific principle that a moving body's kinetic energy does not change unless there is a change in its velocity may be applied to advantage in centrifugal pump design and operation. This discovery has been applied to the subject invention described below and its application combined with improved basic impeller and pump chamber design has resulted in a centrifugal pump which exhibits several desirable characteristics setting it apart from other centrifugal pumps currently known to the prior art. The present invention differs from the prior art in several respects relative to operational efficiency, energy input requirements, manufacturing costs and overall versatility owing to the following reasons.

In the past, numerous attempts have been made to improve the poor efficiency of small and medium-size centrifugal pumps, these efforts devoted mainly to changes in impeller design and casing configurations. It appears the bulk of such activities have been based upon well-established "scientific" rules which have caused many researchers to by-pass the fundamental principles which form an integral part of the performance of such devices. It has been widely believed significant hydraulic efficiency could only be attained by physically large centrifugal pumps, that small pumps could not compete successfully because of their small size. It has been believed that pump impellers must be relatively narrow in width, that increasing the dimensions of impellers in that plane would serve no useful purpose. A further belief held that significant liquid velocity could only be obtained by causing the liquid to be pumped to travel a comparatively long path between impeller blades, to "give it time to accelerate". The several experimental prototypes which have formed the basis for the present invention have pointed out the shortcomings of many of the earlier efforts to produce high-efficiency small centrifugal pumps. It has been proven by actual tests of the experimental pumps which led to the present invention that impeller diameter and speed of impeller rotation are more significant to the imparting of kinetic energy to a liquid pumped than impeller blade length, that increasing impeller capacity by increasing its width both increases capacity and reduces frictional drag upon the liquid pumped, both major elements contributing to efficiency.

The subject invention differs from the prior art in that, in spite of its comparatively small size, it performs much like a physically larger pump, i.e., its internal dimensions are such that the liquid volume it transports is high in relation to the surface of the pump's impeller and chamber walls, thereby reducing internal friction. For example, the invention's impeller width is almost as great as its diameter. This "abnormally" wide impeller thereby requires a wide pump chamber in which to revolve, the result in effect simulates some of the internal dimensions of much larger pumps. Since the capacity of the pump is maximized by the design of its impeller, operation closely approaches that of much larger pumps and the pump's efficiency is thereby increased.

Energy input requirements relative to volume pumped are reduced because of the pump's efficiency. For example, a standard, well-designed centrifugal pump having the same external dimensions of the subject invention would be capable of transferring from 70 to 100 gallons of water (per minute) to a head of 5 feet driven by a 1 HP motor at 3450 RPM. The subject invention is capable of transferring 165 gallons of water per minute to a head of 5 feet operating under identical conditions, an increase in hydraulic horsepower efficiency from 65% to 135%. Actual hydraulic horsepower efficiency of a centrifugal pump moving water to a 5-foot head and absorbing 1 HP would range from 9% for 70 GPM to 13% for 100 GPM, where as the efficiency of the subject invention is 21%, an increase of from 65% to 135%. The comparison made is for low-head delivery. Hydraulic horsepower efficiencies for most centrifugal pumps generally increase at higher heads reaching a limit of efficiency close to maximum head capacity. The subject invention performs in a similar manner and maintains its volume and efficiency advantage over conventional centrifugal pumps over its entire performance range.

Manufacturing costs of the subject invention are significantly lower than those of prior-art pumps of equivalent capacity since the invention is physically much smaller, thereby less material is required and fabrication and assembly charges are reduced. The current production model, constructed principally of 6061 aluminum alloy, is of massive construction but weighs only 5 Lbs. which weight includes mounting legs and inlet and outlet nozzles for the use of hoses. A close-coupled version of the invention to be mounted directly on the end of an electric motor would weigh only 4 Lbs. The current model's impeller weighs only 4 oz.

The subject invention is distinctly versatile in that it can transfer a wide range of liquids, either clear or containing semi-solid or even solid particles small enough to pass between the pump's impeller vanes. In addition, because of the pump's small size and light weight, it can be easily installed where pumps of equivalent capacity and of greater external dimensions cannot be utilized because of space limitations. The cost of shipping the subject invention is materially reduced because of its light weight and small size as compared to other centrifugal pumps of the same capacity. Field repair is greatly facilitated due to the pump's small size and light-weight components as compared to other centrifugal pumps of the same capacity and performance. The subject invention, because of its high efficiency, uses only 50% of the energy required by conventional centrifugal pumps of equivalent capacity. Thus the motors used may be smaller, lighter, and of lower cost, this in addition to significant savings in electrical energy.

Pressure developed by the subject invention is comparable to that of prior-art small centrifugal pumps utilizing impellers of the same diameter and rotated at the same speed. The invention's impeller is excessively wide as compared to conventional impeller design but tests have shown the impeller width, partially responsible for the high-volume-to-pump-weight ratio, has little to do with developed hydrostatic pressure. An impeller of the same basic design, but much narrower, was tested and developed the same pressure as the wider impeller, but the flow rate was greatly reduced.

One prototype incorporates an impeller of 2.5 In. diameter and develops a static (no flow) pressure of 16 psi. at approximaty 3450 RPM which permits the pump to operate effectively to a head of at least 32 feet. Another experimental model of similar design, utilizing an impeller of 3.5 In. diameter, developed a static pressure of 24 psi, at approximately 3450 RPM. It would appear that increasing the impeller diameter by a factor of 0.4 would result in an increase in pressure by a factor of 50% providing RPM and all other conditions remain constant. If such a conclusion proved valid by constructing and testing pumps designed in the manner taught by the subject invention's technology, then it could be expected to develop a pressure of 36 psi. from an impeller of 4.9 In, diameter, a pressure of 54 psi. from an impeller of 6.86 In. diameter, a pressure of 81 psi. from an impeller of 9.604 In. diameter, etc. The subject invention is designed to operate with conductors of 2.5 In. internal diameter, this in keeping with the purpose of the total operational design, i.e., reduction of friction losses to a minimum by keeping the cross section of liquid flow very large in relation to the area of the impeller, the pump chamber walls and the conductors, both inlet and outlet.

The current invention prototype, although very small, is capable of performance greatly superior to that of other centrifugal pumps of equal external dimensions and represents the basic design for centrifugal pumps of virtually any size and capacity. The tested and calibrated performance of the invention has proven the practicality of its design which lays the foundation for a wide range of centrifugal pumps of various sizes designed for a variety of applications. It is anticipated the development of the unique combination of design principles of the invention will result, it thoroughly explored, in a lasting contribution to all concerned with the advantages offered.

SUMMARY OF THE INVENTION

Figure 1:
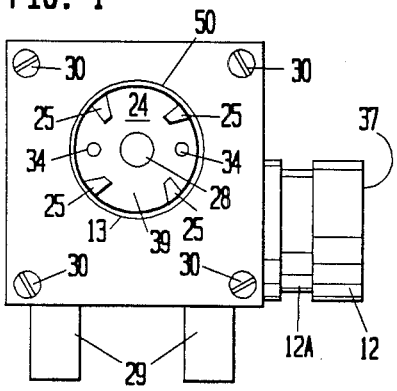
FIG. 1 is an external front view of the assembled invention showing a front view of the pump's intake nozzle and a side view of its outlet nozzle.

A small high-capacity centrifugal pump for the transfer of liquids is presented. The terminology "pump" is used to describe said structure subsequently. The pump comprises four modules or components held in rigid assembly by means common to the art such as screws, bolts, pins, or the like. The drive component consists of a drive shaft containing a keyway an key, a collar attached to the shaft by means of a pin, an impeller mounting fixture attached to the drive shaft by means of a pin. The inboard end of the drive shaft is threaded for installation of the pump impeller.

The pump housing component is a one-piece casting containing a circular pump chamber, a hole (board off center relative to the diameter of the pump chamber) for installation of the drive shaft component, an outlet nozzle of very large internal diameter, and two legs for mounting the pump on a suitable base. The hole for mounting the pump drive unit is bored to accept the drive unit's impeller mounting fixture, and it incorporates a seal gland and lip seal and a set of flanged sleeve bearings to support the drive shaft and control end-thrust loads in both directions.

The impeller component is a one-piece casting of a width slightly less than the impeller's diameter. It incorporates four almost full-length vanes, is threaded at the inboard end for mounting on the threaded end of the impeller mounting fixture, and is open at the opposite end except for a narrow circular integral ring which serves as a sealing member between the rotating impeller and the stationary pump chamber wall.

The end plate component is a one-piece casting incorporating an inlet nozzle of large inside diameter, a seal gland in which is installed on O-ring seal of sufficient diameter to make contact slightly outside the edge of the pump chamber cavity of the pump housing component, mounting holes for installation of the component to the pump housing component.

The pump, with all components assembled, is designed to stand alone, i.e., to be attached by a flexible coupler to suitable drive means such as an internal combustion engine or electric motor. The impeller is located within the pump chamber in such a position that the surrounding area approximates the shape of involute chambers common to conventional single-stage centrifugal pumps. In operation, the drive means rotates the pump shaft at high speed (recommended 3450 RPM), liquid is admitted by a suitable attaching conductor (such as hose or pipe) to the input nozzle which is located concentric with the open end of the pump's impeller, the liquid is accelerated to high velocity within the rotating impeller and escapes from the impeller at its periphery, enters the surrounding cavity where its velocity (kinetic energy) is partially converted to pressure, the liquid exiting (the larger portion directly) from the escape chamber into the offset outlet nozzle and thence into a suitable attaching conductor such as a hose or pipe.

The high capacity (relative to external dimensions) and efficiency of the invention are attributed to a unique combination of design innovations resulting in a centrifugal pump possessing multiple advantages over pumps known to the prior art.

The basic designs and their combinations are intended to apply to centrifugal pumps of any size and should not be construed as limited to the various experimental prototypes herein described and claimed.

The most significant elements which in combination (as disclosed) result in the high performance pump invention are:

1. An impeller of much greater width than conventional centrifugal pump impellers. The ratio of impeller width to diameter can range from 0.25 to 5, preferably from 0.5 to 1.5. The impeller incorporates 4 or more parallel blades which extend the length of the impeller and the impeller has a much larger opening at its liquid admission end than conventional impellers.

2. A circular pump chamber designed to mount the impeller off set from its center to simulate the involute escape chambers common to conventional single-stage centrifugal pumps.

3. Exceptionally large internal diameter inlet and outlet ports to accept conductors of very large internal diameter to minimize friction and reduce turbulence (random motion) of liquids pumped. The inlet and outlet ports have diameters from 75 to 100 percent, preferably from 85 to 100 percent, and most preferably, from 95 to 100 percent, of the impeller diameter.

4. An exceptionally short flow path from inlet to outlet to minimize friction, turbulence (random motion) and energy conversion. Conventional centrifugal pumps are generally designed to convert liquid velocity (kinetic energy) produced by their impellers to pressure (potential energy) in their lengthy (spiral or involute) escape chambers and finally to convert the developed pressure back to velocity as the liquid leaves the pump to flow into the outlet conductors. This multiple energy conversion process results in loss of efficiency. The disclosed high-efficiency pump is designed to minimize conversion of velocity to pressure and to direct a maximum of the fluid it pumps directly from the outlets of its impeller to the large diameter outlet port.

DETAILED DESCRIPTION

Figure 2:
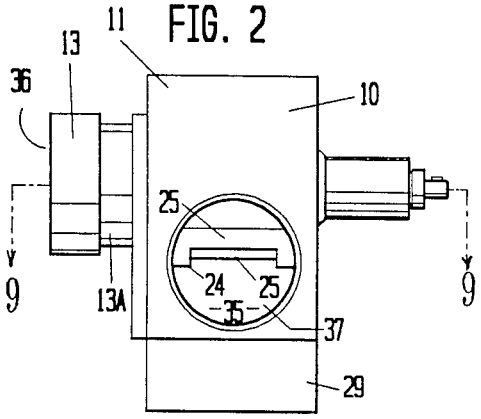
FIG. 2 is an external side view of the assembled invention showing a front view of the pump's outlet nozzle and a side view of its intake nozzle.

Reference is made at this time to FIGS. 1 and 2 which show external views of the preferred embodiment of the invention, viz a high-capacity centrifugal pump. In common with some other centrifugal pumps known to the prior art, the invention incorporates mounting legs 29, attaching assembly screws 30, an input nozzle 13, an outlet nozzle 12, an impeller 24 with multiple equally-spaced vanes 25, an end plate 11 attached by assembly screws 30 to a pump chamber housing 10 to form chamber 35, a drive shaft 16, a key 15, a bearing collar 17 pinned to the drive shaft 16 by a pin 18, and a bearing 19.

One of the features of the pump of this invention is the large diameter inlet nozzle or port 13. This port has a diameter which is from 75 to 100%, preferably from 85 to 100%, and most preferably from 95 to 100%, of the diameter of the impeller 24. This is in keeping with the objective of maintaining minimal pressure loss through the pump. It is desirable to maintain the inlet port diameter as large as the impeller to avoid frictional entrance losses. The second feature of the pump is shown in FIG. 2, which illustrates that the outlet nozzle 37 is also quite large relative to the pump housing and impeller. This port 37 is also from 75 to 100%, preferably from 85 to 100%, and most preferably from 95 to 100%, of the diameter of the impeller 24.

Figure 3:
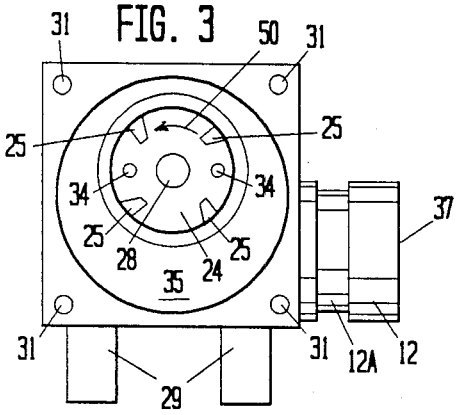
FIG. 3 is an internal front view of the assembled invention (minus the component incorporating its intake nozzle) showing the inside of the pump and its impeller.

FIG. 3 shows the assembled pump with its end plate 11 removed thereby revealing its internal construction as viewed from the input end of the impeller 24 and the position of the impeller 24 relative to the pump chamber 35. Also shown are tapped holes 31 for mounting end plate 11 by means of screws 30 to the pump chamber housing 10. The threaded end 28 of the drive shaft 16 is shown mounted to the threaded hole of the impeller 24. Also shown are impeller installation and removal holes 34 which facilitate assembly and disassembly of the impeller 24 from the drive shaft 16 by means of a suitable spanner wrench (not shown).

Figure 4:
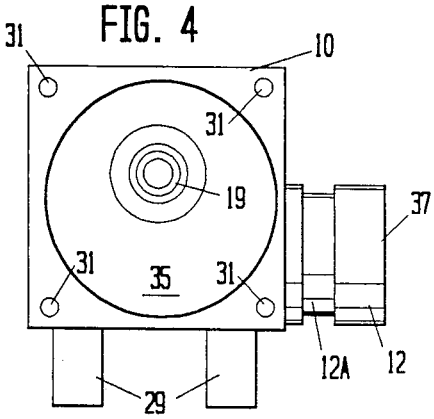
FIG. 4 is a front view of the invention's pump housing component.
Figure 9:
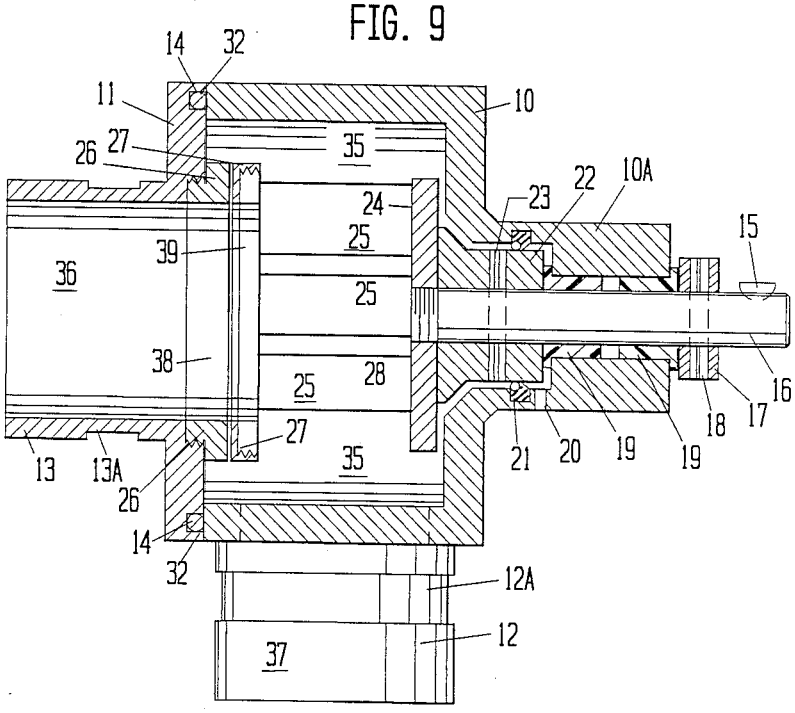
FIG. 9 is a transverse cross sectional view of the assembled invention shown in FIG. 2 taken on the line 9—9 thereof.

FIG. 4 shows the pump chamber housing 10 of the invention and reveals the end of a flanged sleeve bearing 19 which is used to maintain running clearance between the impeller 24, the impeller mounting fixture 22, and the inside surfaces of the pump chamber housing 10 (See FIG. 9).

Figure 5:
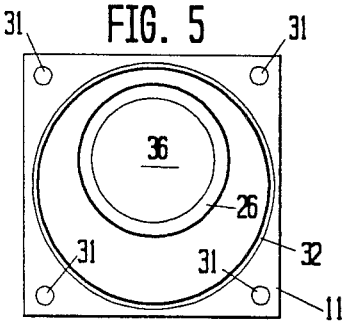
FIG. 5 is a back (side facing the inside of the pump) view of the invention's end plate component.

FIG. 5 shows the end plate 11 as seen from the side mounted to the pump housing 10 revealing a groove or gland 32 in which is installed a sealing O-ring (See FIG. 9, 14).

Figure 6:
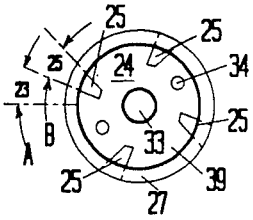
FIG. 6 in an intake end view of the invention's impeller component.

FIG. 6 shows the input end view of the pump impeller component 24 which includes four equally-spaced vanes 25, installation holes 34, and threaded hole 33 for assembly to the threaded end 28 of the drive shaft 16. In a preferred embodiment, the impeller 24 is designed to rotate in a counter clockwise direction as viewed from its open or input end 39 and as shown by the arrow 50 indicating direction of rotation FIG. 1. In this embodiment, the impeller hole 33 and threaded shaft end 28 have right-hand threads which cause the two components to tighten when they are operated in the proper direction. The angle "A" of the leading surface of vane 25 as related to the center line of the impeller 24 is approximately 23 degrees as shown, but experimentation has shown that the pump performs at approximately the same efficiency when the vane or blade angle is as little as 10 degrees or as great as 45 degrees. The angle "B" of the trailing surface of vane 25 as related to the leading surface (angle "A") of the vane 25 is shown to be approximately 25 degrees, but this angle may be varied to achieve an optimum balance between structural strength of the vanes 25 and the space between adjacent vanes 25 to maximize the size of solid and semi solid particulates which may be pumped. The recommended range for angle "B" is 20 degrees minimum to 45 degrees maximum. The impeller 24 as shown incorporates four vanes 25 and is the preferred design to permit pumping relatively large particles of solids and semi-solids thereby increasing the versatility of the pump. Fewer or more vanes may be used to maximize flow and strength, depending upon the operational requirements of the pump.

Figure 7:
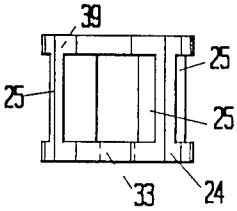
FIG. 7 is a side view of the invention's impeller component showing its parallel vanes.

FIG. 7 shows a side view of the impeller 24 revealing the relative length of its four parallel vanes 25 and showing the threaded mounting holes 33 and the open or input end holes 39. This illustration also points up another significant feature of the pump, in keeping with the objective of minimizing pressure drop, and energy loses in the pump, while providing maximum capacity in a small-sized pump. As shown in FIG. 7, the width of the impeller is quite large, relative to its diameter. The ratio of useful impeller widths to diameters can be from 0.25 to 5, preferably from 0.5 to 1.5. In the illustrated embodiment, the ratio is about 1.

Figure 8:
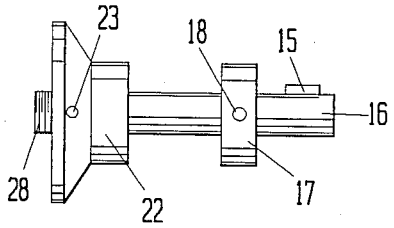
FIG. 8 is a view of the invention's assembled drive unit component.

FIG. 8 shows a side view of the pump's drive component which consists of a drive shaft 16, a key 15, a bearing space collar 17, an assembly pin 18, an impeller mounting fixture 22, an assembly pin 23, and a threaded shaft end 28 for mounting impeller 24 by means of its threaded assembly hole 33.

FIG. 9 shows a transverse cross-sectional view of the assembled pump as shown in FIG. 2 taken on the line 9—9 thereof. This illustration reveals the detailed structure of the pump and the relation of its components both in size and location. The pump chamber component 10 consists of a single piece casting incorporating an outlet nozzle 12 of large diameter containing an intermediate portion 12A of reduced diameter to facilitate the installation and sealing of a suitable outlet hose by means of a circular clamp (not shown). The right-hand end of the pump chamber component 10 includes a cylindrical extension 10A in which are installed two flanged sleeve bearings 19, a lip seal 21 and a drive component which consists of a drive shaft 16, a key 15, a bearing space collar 17, an assembly pin 18, an impeller-mounting fixture 22 and an assembly pin 23. The threaded end 28 of the drive shaft 16 is shown assembled to the impeller 24 and portions of three of the four impeller vanes 25 are shown. The impeller 24 is shown with an attached threaded wear ring 27. The end plate component 11 consists of a single piece casting incorporating an inlet nozzle 13 of large diameter containing an intermediate portion 13A of reduced diameter to facilitate the installation and sealing of a suitable inlet hose by means of a circular clamp (not shown). A sealing O-ring 14 installed in a groove or gland 32 is shown and a threaded wear ring 26 is shown which matches the wear ring 27 of the impeller 24. The clearance space 38 between the stationary wear ring 26 and the rotating wear ring 27 is approximately 0.005 In. in width to effect a hydraulic seal for preventing pressurized liquid in the pump chamber 35 from leaking back into the low-pressure intake port 36 and thereby reducing hydrostatic pressure and loss of pumping efficiency. The clearance space 38 is accurately maintained by the right-hand end of the impeller mounting fixture 22 which serves as a bearing surface against the flange of bearing 19 and the left-hand surface of collar 17 which serves aa a bearing surface against the flange of bearing 19 as shown in FIG. 9. The amount of running clearance between the two flanges of the bearings 19 depends upon the temperature range of liquids to be transported and is determined by the expansion characteristics of the drive shaft 16 and the material of the pump chamber casting 10.

In regards to the impeller 24 and its vanes 25, it should be noted that the vanes 25 are exceptionally short and do not come as close to the center hole 33 of the impeller 24 as would be the case for conventional impeller design. (See also FIG. 6). Experiments with impellers of this type have shown performance is not materially improved insofar as increasing the volume of pumped material is concerned by incorporating vanes with inside tips which extend into the "eye" of the impeller. In fact, good results have been attained with vanes having a radial length one-half the length of the vanes shown in FIG. 6, although impellers with extremely short vanes did not perform as well as the impeller shown in FIG. 6 which is the preferred embodiment described in the drawings. For optimum performance, it is recommended the impeller radial vane length be approximately 25% of the outside diameter of the impeller.

The pump operates in substantially the same manner as that of conventional centrifugal pumps in that liquid, slurry or fine particulates to be transferred are fed by suitable means (such as hose or pipe) to the pump's inlet nozzle 13, moves through the large open end 39 of the impeller 24, flows into the spaces between the vanes 25 of the rapidly-rotating impeller 24 where the liquid is accelerated to high velocity and escapes into the pump chamber 35 and, finally, exits through the outlet nozzle 12 and into a suitable conductor (such as hose or pipe). A very small quantity of pressurized liquid may leak past the pump's shaft seal 21 and this "weepage" is drained away through the "weep hole" 20 and could be fed back into the pump's input line if desired. It is recommended that the pump's drive shaft 16 be of a hard stainless steel alloy and that the bearings be of carbon impregnated with a suitable metal such as babbitt or copper as such bearings are self lubricating and impervious to most liquids ordinarily pumped. Porous bronze bearings are impregnated with oil and this oil may be dissolved away by volatile liquids (such as solvents like acetone, alcohol, paint thinner, etc.) causing early bearing failure if such liquids leak past the pump's shaft seal 21 and make contact with its bearing 19 before draining out of the "weep hole" 20.

As described above, the preferred structure shown in FIG. 9 includes replaceable wear rings 26, 27 which are recommended for high-grade pumps where excessive wear caused by abrasive particles in the liquids pumped would ordinarily wear away the critical sealing clearance 38 which should be maintained to control or prevent leaking of the pressurized liquid from the pump chamber 35 into the low-pressure inlet nozzle 13.

EXAMPLE

The disclosed pump structure (incorporating a 4-blade impeller of 2.5 inch diameter and the other elements substantially of the proportions shown in the FIGURES of this application was driven by a one horsepower motor at 3450 rpm and it developed a flow rate of water of 165 gallons perm minute to a head of 5 feet, resulting in a hydraulic horsepower efficiency of 21 percent and a flow rate of 100 gallons per minute to a head of 24 feet, resulting in an efficiency of 61 percent. A slightly larger experimental prototype of the same basic design, incorporating an eight-blade impeller of 3.5 inch diameter, again with its other elements of the same proportions as shown in the FIGURES, driven by a one horsepower motor at 2700 rpm, developed a flow rate of water of 176 gallons per minute to a head of 5 feet, resulting in an efficiency of 22 percent and a flow rate of 120 gallons per minute to a head of 30 feet, resulting in an efficiency of 91 percent.

These performance tests have shown the invention (like other single-stage centrifugal pumps known to the prior art) operates at highest efficiency close to its maximum head. The experimental model utilizing an impeller with eight vanes and having an outside diameter of 3.5. In. developed a maximum hydraulic horsepower efficiency of 91% when pumping to a head of 30 Ft., although its efficiency pumping to a head of 5 Ft. was only 5%. However, this characteristic is typical of other centrifugal pumps. The absorbed horsepower (torque) required to transfer a liquid to a given head at maximum efficiency is, generally, determined by impeller design. The specific relationship of impeller width and diameter, as compared to input torque and drive shaft speed, can generally be determined for specific pump applications by adhering to the basic design parameters taught by the preferred embodiment of the invention.

The performance ratings and efficiency percentages quoted herein are based upon actual testing and actual measurements. Calculations of hydraulic horsepower efficiencies have been based upon the standard equation: Hyd.Hp. Eff. $=GPM\times 8.336\times Head/Hp.\times 33{,}000$, where 8.336 is the weight of one gallon of water at 70 degrees Fahrenheit, Head is expressed in feet and 33,000 is equivalent to 1 Hp. (i.e., 33,000 Lbs.).

Thus, there is shown and described a preferred embodiment of the improved centrifugal pump. Those skilled in the art may now contemplate modifications to this preferred embodiment. For example, it is possible to vary the number, length, thickness, shape, angle or the like of the impeller blades or vanes. The precise positioning of these blades relative to the impeller, per se, can be varied as a function of the precise application of the pump. However, any such modifications which fall within the purview of this description are intended to be included therein as well. It should be understood that this description is intended to be illustrative only and is not intended to be limitative. Rather, the scope of the invention is limited only by the claims appended hereto.

What is claimed is:

1. A centrifugal pump comprising:

a. a housing having an internal chamber;

b. an impeller rotatably mounted in said housing and received in and extending substantially across the width of said internal chamber thereof and having a width to diameter ratio of 0.25 to 5.0;

c. a plurality of vane members and first and second disk members, one of which has a large diameter center aperture, with said vane members extending between said first and second disk members and disposed at equal angular spacings about the periphery of said disk members, thereby forming said impeller;

d. inlet and outlet ports in said housing with the diameter of said inlet port comprising from 75 to 100 percent of the diameter of said impeller, and located in the side wall of said housing discharging directly through said large diameter center aperture in direct fluid communication with said impeller and said outlet port having a diameter from 75 to 100 percent of the diameter of said impeller and being located in a wall of said housing orthogonal to said side wall; and e. a first liquid conductor attached to said inlet port to deliver liquid thereto from a liquid supply, and a second liquid conductor attached to said outlet port to receive liquid therefrom.

2. The centrifugal pump of claim 1 wherein said inlet port has a diameter from 85 to 100 percent of the diameter of said impeller.

3. The centrifugal pump of claim 1 wherein said outlet port has a diameter from 85 to 100 percent of the diameter of said impeller.

4. The centrifugal pump of claim 1 wherein said inlet port has a diameter from 95 to 100 percent of the diameter of said impeller.

5. The centrifugal pump of claim 1 wherein said outlet port has a diameter from 95 to 100 percent of the diameter of said impeller.

6. The centrifugal pump of claim 1 wherein the ratio of the width to diameter of said impeller is from 0.5 to 1.5.

7. The centrifugal pump recited in claim 1 wherein said second disk is adapted to engage drive means for driving said impeller means.

8. The centrifugal pump recited in claim 7 including sealing means to prevent leakage of liquid from said chamber around said drive means which includes a stationary annular wear ring on the inside wall of said pump housing, surrounding said inlet port, and a coacting rotating wear annular wear ring carried on said impeller and supported in close axial proximity to said stationary wear ring.

9. The centrifugal pump recited in claim 1 wherein said vane members each includes a trailing edge at an angle of about 25° relative to their leading edge.

10. The centrifugal pump recited in claim 9 wherein said vane member includes a leading edge at an angle of 10° to 45° relative to the center line of said impeller means.

11. The centrifugal pump recited in claim 9 wherein said vane members are angulated relative to said impeller means.

12. The centrifugal pump recited in claim 9 wherein said vane members extend from the periphery of said impeller means toward but not to the center of said impeller means.

13. The centrifugal pump recited in claim 12 wherein said impeller means includes four vane members spaced equidistant about the periphery of said impeller means.

14. The centrifugal pump recited in claim 12 wherein said vane members extend less than halfway from said periphery towards the center of said impeller means.

15. The centrifugal pump recited in claim 1 wherein said impeller means includes four vane members spaced equidistant about the periphery of said impeller means.

16. The centrifugal pump recited in claim 1 including drive means connected to said impeller means such that a rotating drive force can be supplied to said impeller means.

17. The centrifugal pump recited in claim 1 wherein said inlet and said outlet are offset from each other.

18. The centrifugal pump recited in claim 1 wherein said inlet is off center relative to said chamber means.

19. The centrifugal pump recited in claim 1 wherein said impeller means and said inlet include wear bearings mounted adjacent each other.

20. The centrifugal pump recited in claim 1 wherein said chamber includes a cylindrically shaped cavity formed in said housing to receive said impeller means.

21. The centrifugal pump recited in claim 1 wherein said inlet is detachable from said housing.

22. The centrifugal pump recited in claim 1 wherein said outlet and said housing are formed of a unitary member.

* * * * *